United States Patent [19]

Asaeda et al.

[11] 4,073,281

[45] Feb. 14, 1978

[54] TRUING AND DRESSING APPARATUS FOR GRINDING WHEELS

[75] Inventors: Toshio Asaeda, No. 1-9-19, Kaminoge, Setagaya, Tokyo; Ikuo Suzuki, Chiryu, Japan; Tomoyasu Imai, Kariya, Japan; Masato Kitajima, Hekinan, Japan; Kazunori Hota, Okazaki, Japan

[73] Assignees: Toyoda-Koki Kabushiki-Kaisha; Toshio Asaeda, both of Tokyo, Japan

[21] Appl. No.: 737,043

[22] Filed: Oct. 29, 1976

Related U.S. Application Data

[63] Continuation-in-part of Ser. No. 727,678, Sept. 29, 1976, abandoned.

[30] Foreign Application Priority Data

| | | |
|---|---|---|
| Sept. 29, 1975 | Japan | 50-117402 |
| Sept. 29, 1975 | Japan | 50-117403 |
| Oct. 14, 1975 | Japan | 50-124084 |

[51] Int. Cl.[2] ..... B24B 53/04

[52] U.S. Cl. ..... 125/11 CD; 51/263

[58] Field of Search ..... 51/263; 125/11 R, 11 CD

[56] References Cited

U.S. PATENT DOCUMENTS

| | | | |
|---|---|---|---|
| 2,219,641 | 10/1940 | Taylor | 51/263 X |
| 3,263,668 | 8/1966 | Strauss | 125/11 R |
| 3,314,410 | 4/1967 | Knauer | 125/11 R |
| 3,407,800 | 10/1968 | Hoare | 125/11 R |
| 3,971,358 | 7/1976 | Sawluk | 125/11 CD |

FOREIGN PATENT DOCUMENTS

| | | | |
|---|---|---|---|
| 465,869 | 5/1937 | United Kingdom | 125/11 CD |

*Primary Examiner*—Harold D. Whitehead
*Attorney, Agent, or Firm*—Oblon, Fisher, Spivak, McClelland & Maier

[57] ABSTRACT

An apparatus for successively truing and dressing a grinding wheel made of cubic boron nitride (CBN) with a diamond-impregnated truing roll and a metal dressing roll. The truing and dressing rolls are rotatably mounted on a roll carriage which is slidably mounted on a grinding machine so as to feed the rolls toward the CBN wheel and thereafter traversely move the rolls along the wheel surface of the CBN wheel. After truing with the truing roll, a coolant fluid mixed with liberation abrasive grain is supplied toward a gap of a predetermined distance, smaller than the mean size of the abrasive grain, which is established between the CBN wheel and the dressing roll, so that the liberation abrasive grain acts to grind and remove bond material from the wheel surface in order to accomplish the dressing of the CBN wheel.

17 Claims, 15 Drawing Figures

4
27
16
18
14
13
t
21
22
23
24
19
11
10
20
12
51
50
LS1
26
25
53
SOL3
SOL1
52
54
P
P
M
31
28
30
29

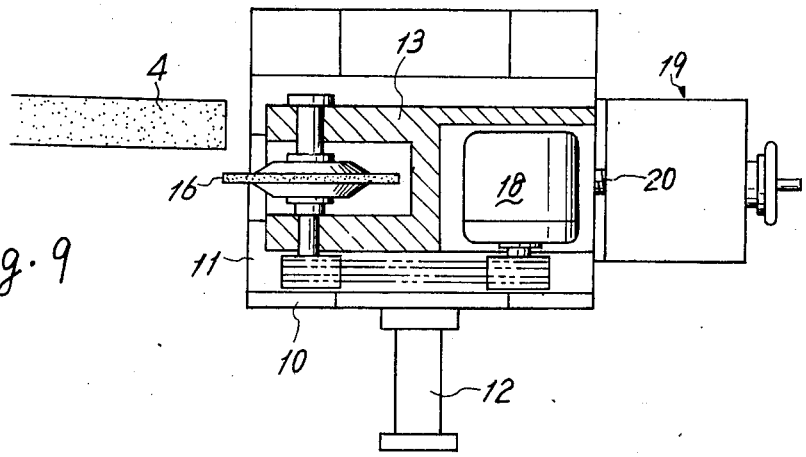
Fig. 9
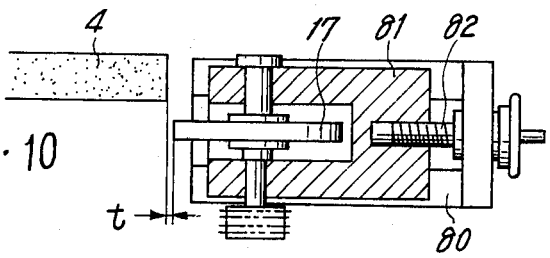
Fig. 10
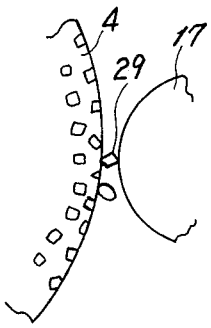
Fig. 11
Fig. 12
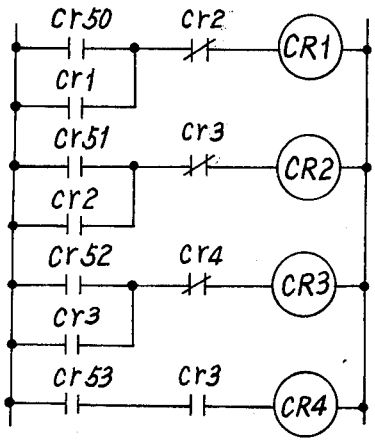

TRUING AND DRESSING APPARATUS FOR GRINDING WHEELS

CROSS REFERENCE TO RELATED APPLICATIONS

This application is a Continuation-In-Part Application of U.S. application Ser. No. 727,678, filed Sept. 29, 1976, now abandoned, the subject matter of which is incorporated in entirety herein.

BACKGROUND OF THE INVENTION

1. Field of the Invention

The present invention relates generally to a grinding machine and, more particularly, to an apparatus for successively truing and dressing a grinding wheel made of hard abrasive, such as cubic boron nitride.

2. Description of the Prior Art

In truing a so-called CBN grinding wheel made of cubic boron nitride, heretofore, it has been attempted to use a truing device with a silicon carbide grinding wheel. In such a prior art truing technique, the device is first placed on a worktable of a grinding machine, and relative feed movement is then made between the CBN wheel and the worktable, whereby the truing of the CBN wheel is carried out. The CBN wheel is further required to be dressed after truing. In a prior art dressing technique therefor, an abrasive impregnated wax stick is employed and applied to either the wheel surface of the CBN wheel or the cylindrical surface of a workpiece. When contact is effected between the CBN wheel and the workpiece, the liberation abrasive grain intervening therebetween serves to grind and remove bond material from the wheel surface so as to thereby open a plurality of pores thereon.

The prior art truing and dressing techniques, however, depend on the manual labor of an operator, and therefore raise many problems not only with respect to the safeness of the work, but also relating to the accuracy and efficiency of the truing and dressing operations. Most especially, as human intervention is required, both techniques are impossible to be applied to grinding machines which are fully automatized for use in a mass-production line.

With the dressing technique, moreover, wear of the CBN wheel is undesirably increased. More specifically, since the size of the pores opened on the wheel surface largely influences the metal removing ability of the CBN wheel, as generally known, abrasive grain used in dressing has to, therefore, be determined in taking consideration of the metal removing ability which is asked of the CBN wheel. If it is tried in the prior art technique, nevertheless, to open large pores on the wheel surface by the use of grain of significant size, excessive removal of the wheel bond material is necessarily brought about, due to the fact that complete contact is made between the workpiece and the CBN wheel, thus facilitating CBN abrasive grain to fall from the wheel surface. In addition, since the stick employed in dressing has as its chief ingredient a wax, such as polyethylene glycol, using the stick allows the grain for dressing to be scattered and deposited on the machine, and, in consequence, frequent maintenance for the machine becomes necessary.

SUMMARY OF THE INVENTION

It is therefore a primary object of the invention to provide a truing and dressing apparatus for CBN wheels which is coordinated to be equipped on a fully automatized grinding machine.

Another object of the invention is to provide an improved truing and dressing apparatus which, without causing CBN grain to fall off from a CBN wheel, is able to provide on the wheel surface pores large enough to obtain a desired metal removing ability.

A further object of the invention is the provision of an improved truing and dressing apparatus which does not allow abrasive grain for dressing to be deposited on a grinding machine and which is helpful in discharging the grain from the machine.

A specific object of the invention is to provide an improved truing and dressing apparatus in which a gap of a predetermined distance is established between a CBN wheel and a dressing roll so as to make the use of large size abrasive grain practicable.

Another specific object of the invention is to provide an improved truing and dressing apparatus in which a difference in size is provided between truing and dressing rolls rotatable about a common axis for establishing a gap of a predetermined distance between a CBN wheel and the dressing roll.

A further specific object of the invention is to provide an improved truing and dressing apparatus which is capable of re-adjusting the size of a dressing roll in order to maintain invariable a gap of a predetermined distance between the dressing roll and a CBN wheel.

A still further specific object of the invention is the provision of an improved truing and dressing apparatus wherein the relative position of a dressing roll to a CBN wheel is adjustable independently of a truing roll for desirably adjusting a gap between the dressing roll and the CBN wheel.

Briefly, the foregoing and other objects of the present invention are achieved through the provision of a truing and dressing apparatus which comprises a roll carriage slidably mounted on a grinding machine and rotatably supporting thereon a diamond-impregnated truing roll and a dressing roll, infeed means for moving the roll carriage in a first direction heading for a CBN wheel rotatably supported on the machine, traverse feed means for moving the roll carriage in a second direction transversally relative to the first direction, and means for supplying liberation abrasive grain between the wheel and the dressing roll during the dressing operation.

The in-feed means and the traverse feed means are sequentially operable in response to a truing and dressing command, so that after being advanced toward the wheel, the roll carriage is transversely moved to effect the truing of the wheel with the truing roll. The dressing roll is arranged to establish a predetermined gap between itself and the wheel when the roll carriage is positioned with the dressing roll facing the wheel after the truing operation. In the subsequent dressing operation, accordingly, the liberation abrasive grain, when acting to grind and remove bond material from the wheel surface, effects shallowly and as a result, falling of CBN abrasive grain from the wheel surface can be decreased, resulting advantageously both in raising the machining accuracy and in elongating the tool life.

BRIEF DESCRIPTION OF THE DRAWINGS

Various other objects, features and attendant advantages of the present invention will be readily appreciated as the same becomes better understood by reference to the following detailed description when considered in connection with the accompanying drawings, in which:

FIG. 9 shows a cross-sectional view of the device taken along the line IX—IX of FIG. 8;

FIG. 10 shows a cross-sectional view of the device taken along the line X—X of FIG. 8;

FIG. 11 is a schematic representation showing the condition of dressing in exaggerated scale;

FIG. 12 shows a rough diagram of an electrical control circuit for the third preferred embodiment.

DETAILED DESCRIPTION OF THE PREFERRED EMBODIMENTS

Figure 1:
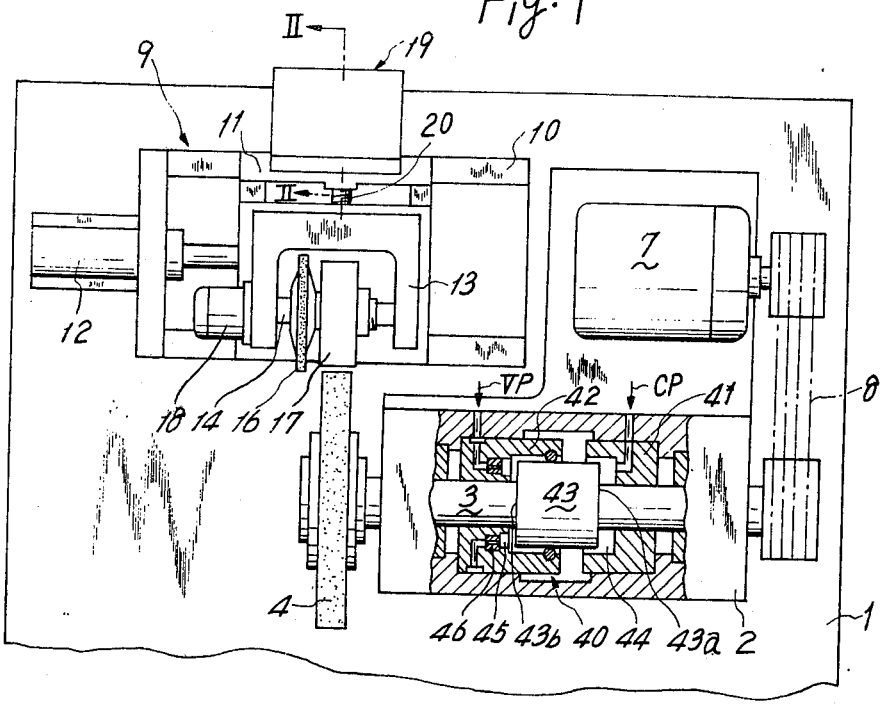
FIG. 1 shows a plan view, partly in section, of a preferred embodiment of the invention.

Referring now to the drawings, wherein like reference numerals designate like or corresponding parts throughout the several views, and particularly to FIG. 1 thereof, the reference numeral 1 designates a machine bed of a grinding machine on which a wheel head 2 is mounted, and a grinding wheel 4 is attached on one end of a wheel spindle 3 rotatably supported on the wheel head 2. The grinding wheel 4 is of such configuration that abrasive grain, being made of a hard material, such as cubic boron nitride, is press-formed and stiffened on the outer peripheral surface of a metallic base ring 5 (FIG. 3) with a well-known resinoid or metal bond. The wheel spindle 3 is drivingly connected at its other end with a wheel motor 7 through driving belts 8.

On the machine bed 1, there is further mounted a truing and dressing apparatus 9, a fixed base 10 of which slidably guides a traverse slide 11 in a direction parallel with the axis of the spindle 3, and the traverse slide 11 is drivingly connected with a traverse feed cylinder 12 secured on the fixed base 10 so as to be slided thereby. Mounted on the traverse slide 11 and slidable radially of the grinding wheel 4 is a roll carriage 13, by which a roll support spindle 14 is rotatably supported with its axis which extends in parallel relation with the wheel spindle 3. Truing and dressing wheels or rolls 16 and 17, for truing and dressing the grinding wheel 4, are securely fixed on the support spindle 14 with a predetermined separation. The truing roll 16 is such that an abrasive grain of hard material, such as diamond, is sintered on the outer periphery of a metal-made base ring with, for example, a copper base alloy, and is designed to have its width less than that of the grinding wheel 4 in order to decrease resistance occurring in the truing operation. The dressing roll 17 is made of refined steel, hardened steel or other material which has the same hardness, toughness and resistance to wear as the refined or hardened steel does, and is designed to have a little greater width than the grinding wheel 4, in addition to having its radius size which, compared with that of the truing roll 16, is small within a grain size (for example 50$\mu$) of aftermentioned liberation abrasive for dressing. Fixedly mounted on the roll carriage 13 is a roll drive motor 18, which is connected by an output shaft thereof with the support spindle 14 and is operable to rotate the truing and dressing rolls 16, 17 in such a direction as to reduce the relative peripheral speed with the grinding wheel 4.

Figure 2:
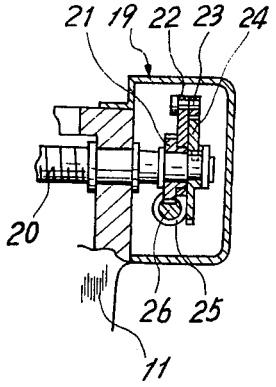
FIG. 2 shows a fragmental sectional view of the device taken along the line II—II of FIG. 1.

With reference to FIG. 2, a dressing in-feed device 19 for feeding the rolls 16, 17 toward the grinding wheel 4 will now be described. A feed screw shaft 20 of the device 19, engaged threadedly with the roll carriage 13, is rotatably supported on the traverse slide 11, without making axial movement, and is further incorporated with a ratchet feed mechanism for effecting intermittent rotation of the screw shaft 20. The mechanism includes a pinion 21, which is fixedly rotatable on the shaft 20, together with a cradle plate 22 pivotably supporting a ratchet pawl 23, which is spring-biased to disengageably mesh with a ratchet wheel 24 keyed on the screw shaft 20. Accordingly, when the ratchet feed cylinder 25 effects sliding movement of a piston-rack 26, thus rotating the pinion 21 and the cradle plate 22, the feed screw shaft 20 is rotated through the ratchet pawl 23 and the ratchet wheel 24, so that the roll carriage 13 may be advanced a predetermined infeed amount (for example 10$\mu$) toward the grinding wheel 4.

Figure 3:
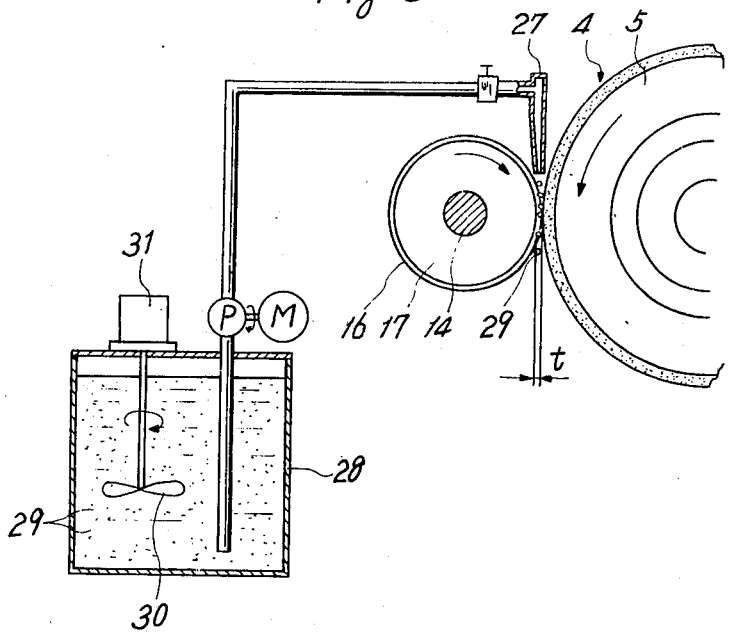
FIG. 3 is a schematic view of the device in dressing condition, particularly being illustrated in connection with a liberation abrasive grain supply device.

In FIG. 3, there is shown a nozzle 27 for ejecting a dressing coolant fluid between the dressing roll 17 and the grinding wheel 4 when faced with each other for dressing after truing, which nozzle 27 is communicated through a coolant pump P, driven by a pump motor M, to a reservoir 28 containing the coolant fluid. Though itself being a solution of water and a conventional water soluble coolant suitable to grinding, for dressing, the coolant fluid is mixed with liberation abrasive grain 29 (mean size: approximately 100$\mu$ in diameter), such as aluminum oxide, silicon carbide or the like, at the rate of, for example, 500g/10*l*. Provided to prevent the liberation abrasive grain from separating from the coolant fluid is a mixing fan 30, which is drivingly connected with a mixing motor 31 so as to be rotated thereby. It is therefore to be noted that the mixing rate between the coolant fluid and the abrasive grain can be maintained proper.

In order to permit the wheel surface of the wheel 4 to be dressed accurately and uniformly, the wheel head 2 has incorporated therewith a wheel oscillation mechanism 40, in which first and second thrust fluid bearings 41 and 42 are fixedly mounted in co-axial alignment with the wheel spindle 3 and in such a manner as to be confronted with each other with a predetermined spacing therebetween. A land portion 43, formed on the wheel spindle 3, has one end **43*a* thereof disposed in a cavernous bore of the first bearing 41 so as to define a fluid chamber 44 therebetween and its other end 43*b* disposed in another cavernous bore of the second thrust bearing 42. At the bottom of the bore in the second thrust bearing 42, there is further provided a plurality of concave fluid pockets 45, which are faced with the other end 43*b* of the land portion 43. A pressurized fluid VP, whose pressure is controlled, to vary periodically, by a suitable pressure regulating device (not shown), is supplied to the fluid pockets 45 through passages formed in the second thrust bearing 42 and throttles fitted in the outlets of the passages, while another pressurized fluid CP, whose pressure is maintained invariable, is supplied to the fluid chamber 44**.

The operation of the apparatus as described above will be explained hereinafter with reference also to an electrical control circuit shown in FIG. 4. When a truing and dressing instruction is issued, the roll drive motor 18 is activated to rotate the truing and dressing rolls 16, 17 and, at the same time, a normally open contact *cr*50 is closed, thus effecting the energization of a magnetic relay CR1 for controlling a magnetic change-over valve (not shown). By having the back chamber admit the pressurized fluid, the ratchet feed cylinder 25 causes the screw shaft 20 to be rotated in a direction of positive-going, through the pinion 21 and the ratchet mechanism, so that the roll carriage 13, along with the truing and dressing rolls 16, 17, is advanced the predetermined feed amount toward the grinding wheel 4.

When the piston-rack 26 of the cylinder 25 returns to its initial position, after one reciprocation thereof, a normally open contact *cr*51 is closed to thereby energize a magnetic relay CR2, and thus a normally closed contact *cr*2 of the relay CR2 deenergizes the relay CR1 by being opened. Depending upon the energized relay CR2, a magnetic change-over valve (not shown) for the traverse feed cylinder 12 is switched, which subsequently moves the traverse slide 11 in a path parallel with the wheel spindle axis at a desired feed rate, whereby the truing of the grinding wheel 4 with the truing roll 16 is performed through the contact therebetween. Upon the completion of one reciprocational traverse movement of the slide 11, the dressing roll 17 is faced again with the grinding wheel 4, between which, in this time, the gap *t* of the predetermined distance is established because of the radius difference between the rolls 16 and 17.

It is to be noted herein that if the roll 17 wears more in dressing than the roll 16 does in truing, the gap *t* between the roll 17 and the grinding wheel 4 will finally become larger than the mean size of the liberation abrasive grain 29 for dressing and, as a consequence, it may become impossible to dress the grinding wheel 4 with the roll 17. It should be realized, accordingly, that in order to maintain the gap *t* accurately invariable, the material and hardness of the rolls 16, 17 have to be chosen, taking into consideration the wear thereof in dressing and truing. As a matter of fact, it may, however, be difficult to maintain the gap *t* accurately invariable. In such a case, it is preferable to employ truing and dressing rolls having a relative wear character which is apt to decrease the gap *t* rather than increase it in the course of the truing and dressing operations, since, as deduced from FIG. 3, the rotational movements of the dressing roll 17 and the grinding wheel 4 are able to compulsorily involve the liberation abrasive grain 29 therebetween, even when the gap becomes considerably smaller than the predetermined distance *t*.

When the traverse slide 11 returns to its original position, as viewed in FIG. 1, as a normally open contact *cr*52 is closed, a magnetic relay CR3 for the pump motor M is energized, thus deenergizing the relay CR2 through opening its normally closed contact *cr*3. Accordingly, the coolant pump P is operated by the pump motor M, and, in consequence, the coolant fluid mixed with the liberation abrasive grain 29 is ejected from the nozzle 27. The liberation abrasive grain 29, which is supplied toward the gap *t*, bites and grinds the bond material supporting CBN grain of the grinding wheel 4 from the wheel surface, as being backed up with the dressing roll 17, so that the wheel 4 is dressed to protrude the CBN grain beyond the remaining bond material.

Depending upon the energization of the relay CR3, the periodically variable pressurized fluid VP is supplied into the fluid pockets 45 through the throttles 46 with the result that a static pressure force, which varies in proportion to the pressurized fluid VP, is created in the fluid pockets 45, and, as the land portion 43 responds to the variable pressurized fluid VP, the wheel spindle 3 is thus oscillated in its axial direction against the force of the stable pressurized fluid CP which is being admitted in the fluid chamber 44. Accordingly, during the aforementioned dressing operation, oscillation of the grinding wheel 4 is effected, so that the wheel surface or the grinding surface of the same, is remarkably enhanced in smoothness. A time relay TR1, which has been energized together with the relay CR3, is switched on after expiration of a preset period of time, thus opening a normally closed contact *tr*1 thereof, and, in consequence, the relay CR3 is deenergized so as thereby to deenergize the roll drive motor 18 and the pump motor M, the dressing operation thus being completed.

Figure 4:
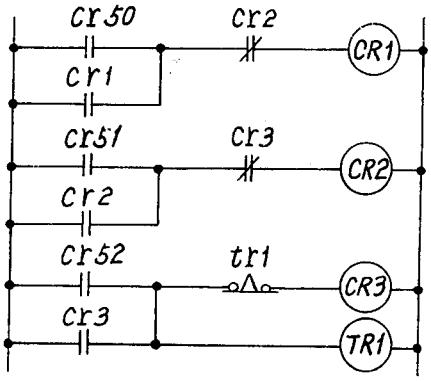
FIG. 4 is a rough diagram of an electrical control circuit for the device shown in FIG. 1.
Figure 4A:
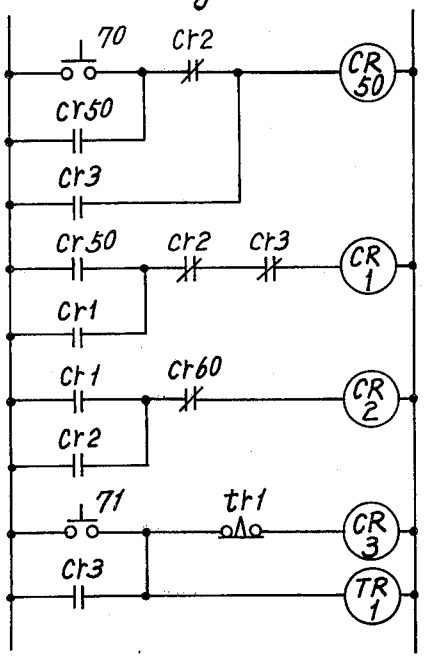
FIG. 4*a* shows a modification of the circuit shown in FIG. 4.

FIG. 4*a* shows a partial modification of that shown in FIG. 4. In this modified circuit, there are provided push button switches 70 and 71 for respectively instructing initiations of the truing and dressing operations. As a normally open contact *cr*3 is provided in parallel relation with the switch 70 and a normally closed contact *cr*2, a relay CR50 for activating the roll drive motor 18 is energized at the time when either the switch 70 or the switch 71 is depressed, and is de-energized at the time when either the relay CR2 for the traverse feed movement of the slide 11 or the relay CR3 for the pump motor M is de-energized.

In order to make the relay CR1 inoperative during the dressing operation, a normally closed contact *cr*3 is provided in the energization circuit of the relay CR1. Furthermore, a normally closed contact cr60 is connected to the energization circuit of the relay CR2 so as to de-energize the same whenever one reciprocation movement of the slide 11 is completed. Under the control of the modified circuit, therefore, the truing and dressing operations can be performed independently of each other, and it is realized that intervals of both the operations can be individually arbitrarily changed so as to elongate the tool life, in other words, to achieve a maximum machining efficiency.

Another preferred embodiment will now be described with reference to FIGS. 5–7, in which every part or member having a function which is identical or otherwise corresponds to that of the foregoing first embodiment is indicated by the same reference numeral. In this particular embodiment, for the purpose of maintaining the gap *t* between the grinding wheel 4 and the dressing roll 17 accurately invariable, there is made an improvement which is associated with the dressing in-feed device 19 and the traverse feed cylinder 12.

Figure 5:
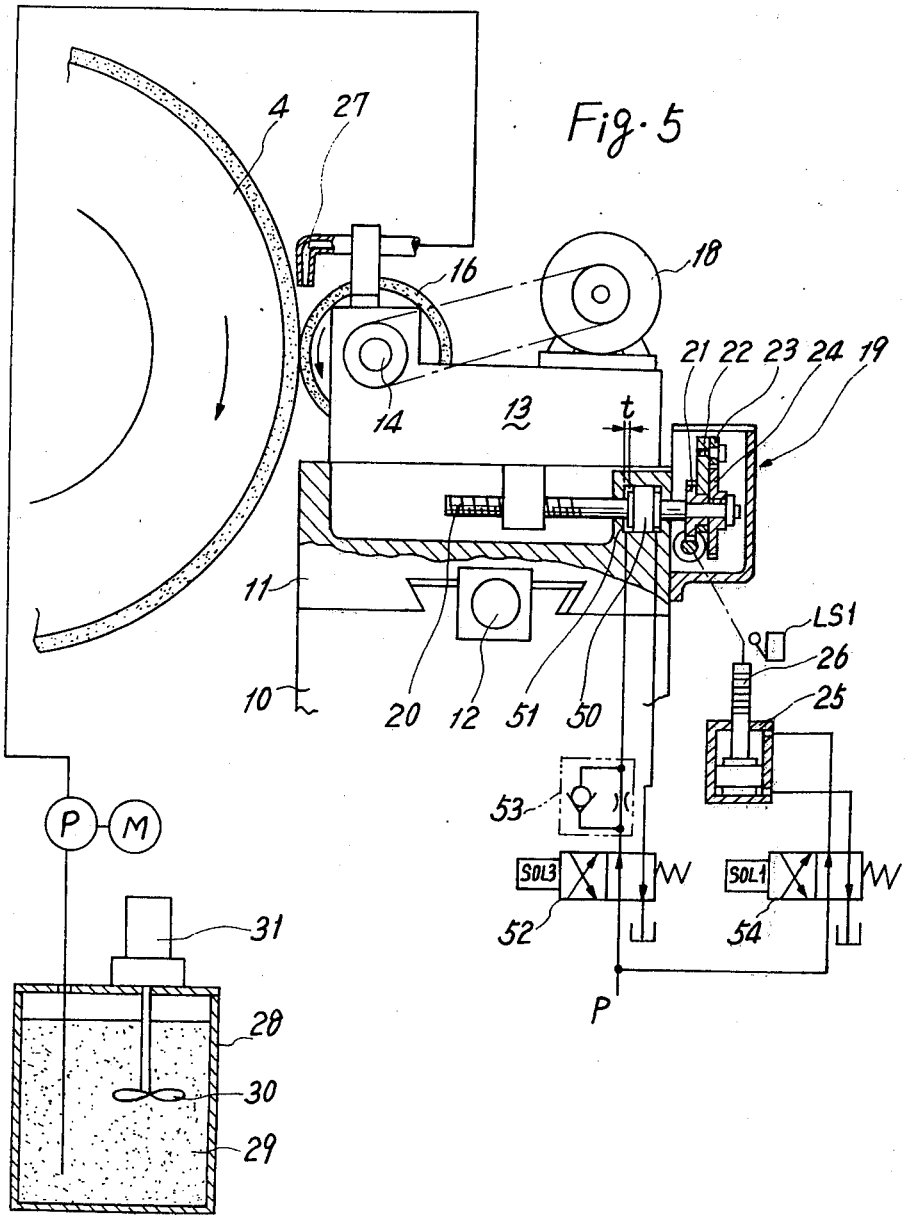
FIG. 5 shows a side elevation view, partly in section, of another, or a second, preferred embodiment of the invention.

As illustrated in FIG. 5, the feed screw shaft 20 is provided with a piston 50, which is fitted in a grinding feed cylinder 51 formed on the traverse slide 11 and which is slidable within a stroke corresponding to the above-mentioned gap *t*. The feed cylinder 51 is communicated to a pressurized fluid supply P through a change-over valve 52, so that, when the valve 52 is switch, the advance movement of the piston 50 is effected and the dressing roll 17 may therefore be fed the amount of the gap *t* toward the grinding wheel 4, so as to be ground thereby. A reference numeral 54 denotes a change-over valve for controlling the ratchet drive cylinder 25, and, with this configuration, the piston-rack 26 is controllably slided between an advanced position where it operates a limit switch LS1 and a retracted position, as shown in FIG. 5.

Figure 6:
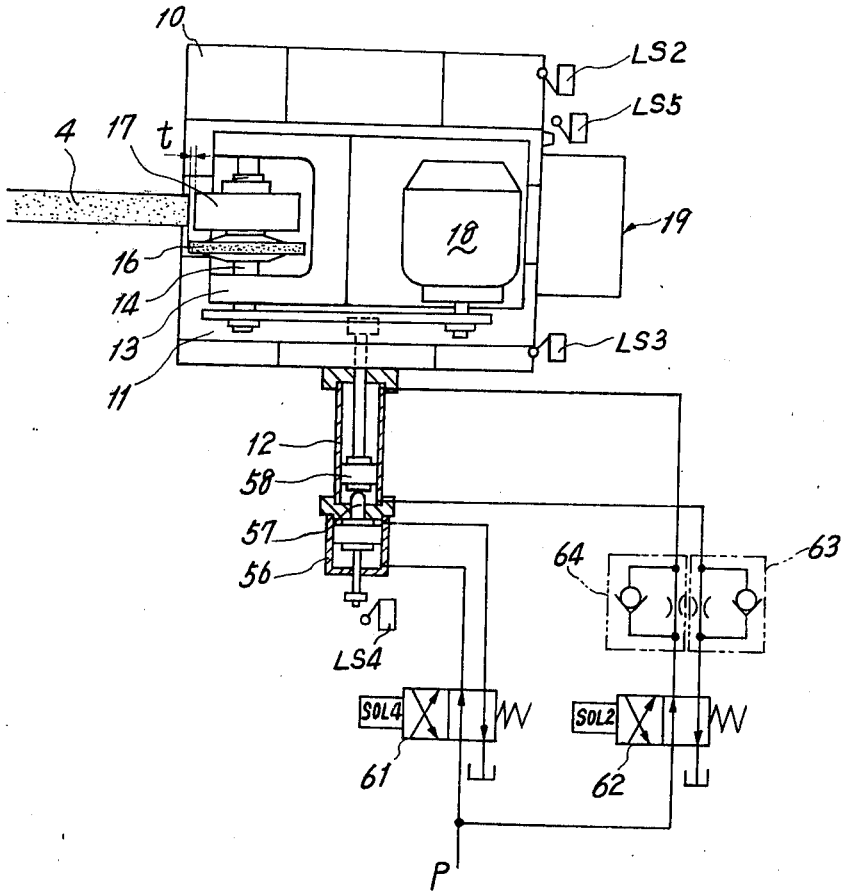
FIG. 6 is a plan view of the device shown in FIG. 5.

The traverse feed cylinder 12, as viewed in FIG. 6, is incorporated with a shift cylinder 56, the piston-rod 57 of which perforates through a partition between the two cylinders 12 and 56. Through its association with a change-over valve 61, the shift cylinder 56 is capable of selectively shifting the piston-rod 57 from a retracted position to an advanced position in which the rearward or retracting movement of the piston 58 is restricted in order to align the dressing roll 17 with the grinding wheel 4 in the radial direction. On the other hand, the traverse feed cylinder 12 is controllable by means of a change-over valve 62 and feed rate setting devices 63 and 64, each comprising a variable throttle with a check valve, and with this arrangement, the relative traverse movement between the grinding wheel 4 and the dressing and truing rolls 17, 16 may be carried out at a predetermined feed rate.

Limit switches LS2 and LS3 are provided for detecting the traverse ends of the slide 11 in the truing operation, while limit switches LS4 and LS5 are provided for detecting the same in the grinding operation for the dressing roll 17. It is therefore clear that the dressing roll 17 may be ground through its entire width with the grinding wheel 4. Again referring to FIG. 5, another feed rate setting device 53, of the same configuration as the devices 63, 64, is disposed between the feed cylinder 51 and the change-over valve 52 for adjusting the grinding feed rate.

Figure 7A:
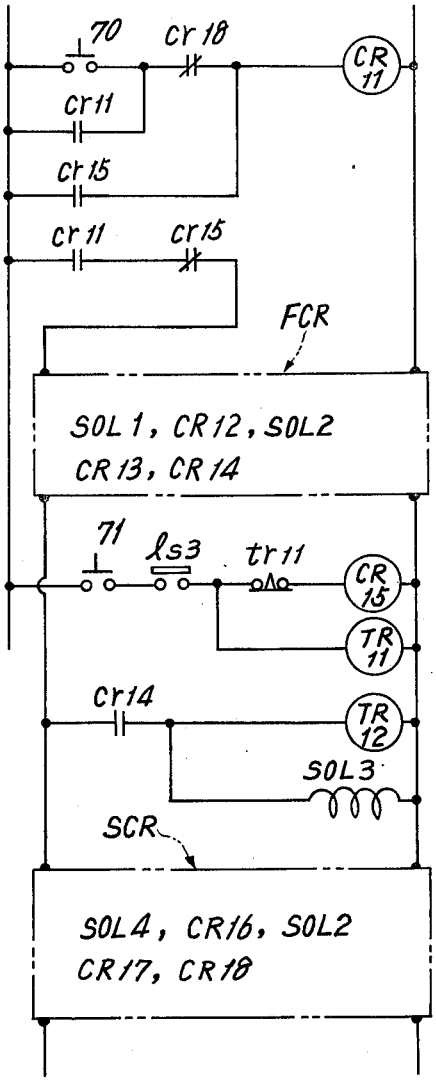
FIG. 7*a* shows a modification of the circuit shown in FIG. 7.
Figure 7:
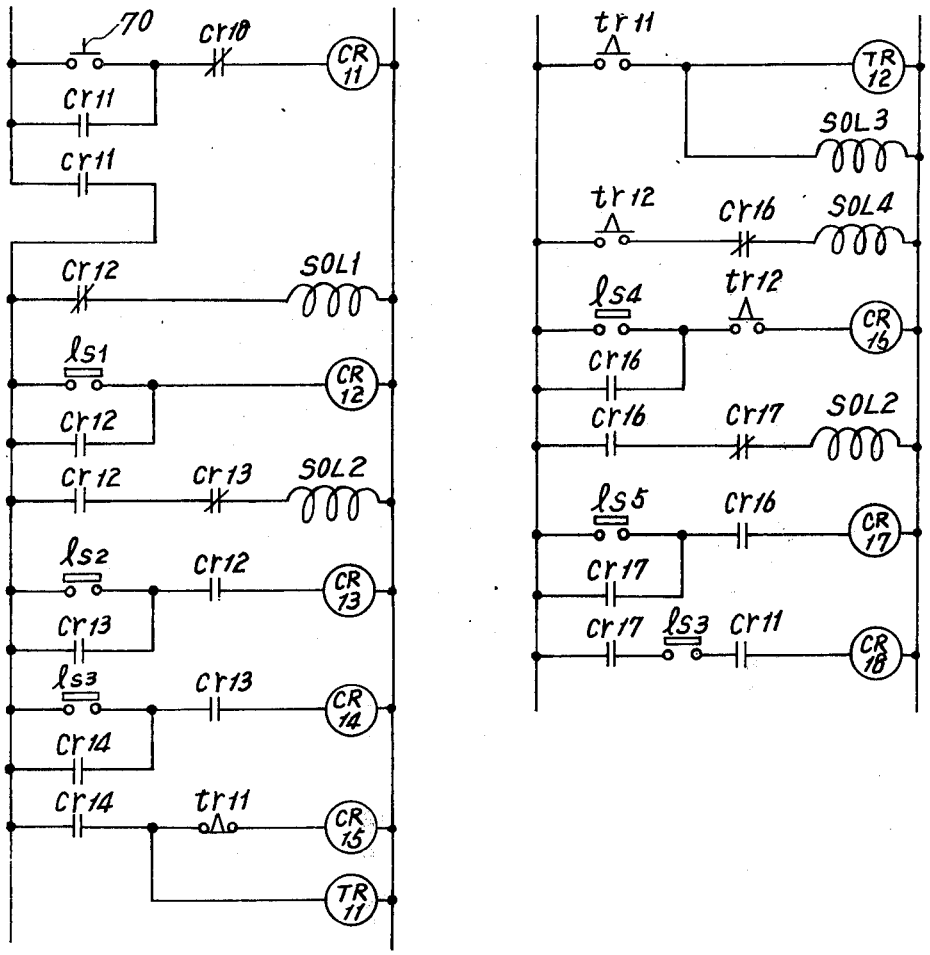
FIG. 7 shows a detailed diagram of an electrical control circuit for the device in the second embodiment.

FIG. 7 shows an electrical control circuit, referring to which the operation of the second embodiment will be described hereinbelow. When a start push button 70 for truing and dressing is depressed, a magnetic relay CR11 is energized and self-held through a self-holding contact cr11 thereof, and consequently, the roll drive motor 18 is operated to rotate the truing and dressing rolls 16, 17 counterclockwise, as shown in FIG. 5, whereby the relative peripheral speed of the rolls, 16, 17 with respect to the grinding wheel 4 is reduced. With the energization of the relay CR11, closing a contact *cr*11, a solenoid SOL1 is energized through a normally closed contact *cr*12 and switches the change-over valve 54. As the pressurized fluid is thus introduced into the back chamber of the ratchet feed cylinder 25, forward movement of the piston-rack 26 is caused, causing the feed screw shaft 20 to be rotated through the rack-pinion and ratchet mechanisms in a positive-going direction, so that the roll carriage 13 is forwardly moved a predetermined feed amount, of which in-feed movement is given to the truing and dressing rolls 16, 17 accordingly.

In response to the limit switch LS1 being made active when the piston-rack 26 reaches the end of its forward movement, a magnetic relay CR12 is energized through a contact *ls*1 of the limit switch LS1 and is self-held. The energization of the relay CR12 deenergizes the solenoid SOL1 by opening the normally closed contact *cr*12 thereof, hence restoring the valve 54 to the original state, as seen in FIG. 5, and the rack-piston 26 is retracted. The energization of the relay CR12 further renders, through a normally open contact *cr*12 thereof and a normally closed contact *cr*13, a solenoid SOL2 energized, which therefore effects switching of the changeover valve 62. As the pressurized fluid is supplied into the back chamber of the traverse feed cylinder 12, that is, the first one of a double-action cylinder device, the piston 58 of the same is advanced, whereby the traverse slide 11 connected to the piston 58 and, therefore, the truing roll 16 are advanced in a direction parallel with the wheel spindle 3 at a feed rate set by the setting device 64, the grinding wheel 4 being thus trued.

When the limit switch LS2 is activated by the slide 11 reaching the end of its advance motion, a magnetic relay CR13 is energized through the limit switch contact *ls*2, and is self-held. A normally closed contact *cr*13, when opened for the energization of the relay CR13, deenergizes the solenoid SOL2, switching the valve 62, and as a result, the traverse slide 11 is retracted at the feed rate set by the feed rate setting device 63. Accordingly, the portions of the grinding wheel 4 which were left from being trued during the last forward traverse movement of the roll 16, are trued with the roll 16 in this stage. Thereafter, at the original position, where the retracting movement of the piston 58 is confined by the piston-rod 57, which is being positioned at its advance end, the traverse slide 11 is stopped to face the dressing roll 17 with the grinding wheel 4, between which, in this situation, the gap *t* of the predetermined distance is established because of the difference between the radii of the truing and dressing rolls 16 and 17. It is to be realized that if the wear of the roll 16 in truing is larger than that of the roll 17 in dressing, the gap *t* becomes smaller.

When the slide 11 returns to its original position, the limit switch LS3 is activated and, through contacts *ls*3 and *cr*13, a relay CR14 is energized, contact *cr*14 of which is thus closed to cause the relay CR15 to be in turn energized. With the energization of the relay CR15, the coolant pump P is operated to eject the coolant fluid from the nozzle 27. The liberation abrasive grain 29, which is supplied together with the coolant fluid toward the gap *t*, bites and grindingly removes the bond material from the wheel surface as being backed up by the dressing roll 17, so that the grinding wheel 4 can be dressed to have the abrasive grain protrude beyond the remaining bond material of the wheel surface. A time relay TR11 has been energized along with the relay CR15 and, after expiration of a predetermined period of time, is timed up to open a normally closed contact *tr*11 thereof. As the relay CR15 is thus deenergized, the coolant pump P is made inoperative and consequently, the dressing operation for the grinding wheel 4 is completed.

A normally open contact *tr*11, when closed for the time-up of the time relay TR11, energizes a solenoid SOL3, by which the change-over valve 52 is switched, and thus the pressurized fluid is supplied to the back chamber of the grinding feed cylinder 51. Through its connection with the piston 50 through the screw shaft 20, the roll carraige 13 is advanced to thereby move the dressing roll 17 a feed amount corresponding to the gap *t* toward the grinding wheel 4, whereby the roll 17 is ground with the wheel 4, the grinding amount corresponding to the difference between the wear of the respective rolls 16 and 17 in the last truing and dressing, so as to re-adjust the gap *t*.

A time relay TR12 is energized together with the solenoid SOL3, and when it is confirmed by the time-up operation of the relay TR12 that the carriage 13 has forwardly moved the feed amount *t*, a normally open contact *tr*12 of the relay TR12 is closed to energize a solenoid SOL4, which thus switches the valve 61. As the pressurized fluid is admitted into the forward chamber of the shift cylinder 56, the piston-rod 57 is withdrawn from the traverse feed cylinder 12 so as thereby to allow the piston 58 of the same to be further retracted. As a result, one of the side portions of the roll 17 which was left from touching with the grinding wheel 4, comes to be ground. When the piston-rod 57 is completely withdrawn, the limit switch LS4 is operated, and a relay CR16 is energized through contacts *ls*4 and *tr*12 and is self-held. With the energization of the relay CR16, opening a normally closed contact *cr*16, the solenoid SOl4 is deenergized, switching the valve 61, and the piston-rod 57 is therefore moved to its forward end.

The relay CR16, when energized, further closes another normally open contact *cr*16 thereof, so as to energize the solenoid SOl2 and, in consequence, the valve 62 is switched to supply the pressurized fluid into the back chamber of the traverse feed cylinder 12. The piston 58 is advanced accordingly, so that the other side portion of the roll 17 which was left from touching with the grinding wheel 4, is also ground. As the limit switch LS5 is operated by the advancing traverse slide 13, a relay CR17 is energized through a contact *ls*5 and is self-held. A normally closed contact *cr*17 is opened as a result of energization of the relay CR17 and deenergizes the solenoid SOL2 to switch the valve 62 and, in consequence, the piston 58 is retracted to the piston where the same contacts the piston-rod 57, the traverse slide 11 returning to the original position thereof. As being operated by the slide 13, returning to the original position, the limit switch LS3 closes its contact *ls*3 to thereby energize a relay CR18, normally closed contact cr18 of which is thus opened, and with the deenergization of the relay CR11, the truing and dressing sequence operation for the grinding wheel 4 is completed.

In case that it is required to perform the truing operation independently of the dressing operation, another control circuit, shown in FIG. 7*a*, is employed in place of that shown in FIG. 7. In this particular instance, the push button switch 70 is appropriated only for instructing an initiation of the truing operation and, in this connection, another push button switch 71 is provided to constitute the energization circuit of the relay CR15, along with a limit switch contact *ls*3 and the timer contact *tr*11. This switch 71 is directly connected to one of power source lines, so that the dressing operation can be carried out independently of the truing operation. A first circuit component FCR is illustrated, for convenience, in the form of a block since it agrees perfectly with the circuit diagram for the solenoids SOL1 and SOL2 and the relays CR12–CR14, shown in FIG. 7. Similarly, a second circuit component SCR agrees perfectly with that of the solenoids SOL4 and SOL2 and the relays CR16–CR18 shown in FIG. 7.

When the switch 70 is depressed, the relay CR11 for the roll drive motor 18 is energized and thus the truing operation is initiated, which thereafter ends with the energization of the relay CR14 confirming the initial position of the slide 11. As a normally open contact *cr*14 of the relay CR14 is connected, the timer relay TR12 is then energized, whereby the dressing roll 17 comes to be ground with the grinding wheel 4, so as to re-adjust the aforementioend gap *t*.

The dressing operation starts from depressing the switch 71 when the initial position of the slide 11 is confirmed by the contact *ls*3 having been closed. The relay CR15, when energized, closes its normally open contact *cr*15, through which the relay CR11 for the roll drive motor 18 is in turn energized, and allows the pump motor M to operate. In this time, the truing operation and the grinding operation are no longer performed because a normally closed contact *cr*15 provided between the contact *cr*11 and the first circuit component FCR is opened.

A third preferred embodiment will now be described with reference to FIGS. 8–12. In order to ease adjustment of the aforementioned gap *t*, this embodiment is incorporated with an improvement which is directed to the mounting configuration of the dressing roll. It should be realized, accordingly, that as performing the same function as that of the first embodiment, every part or member which is indicated by the same reference numeral as in the first embodiment, is omitted from the following description for the purpose only of avoiding repetition.

Figure 8:
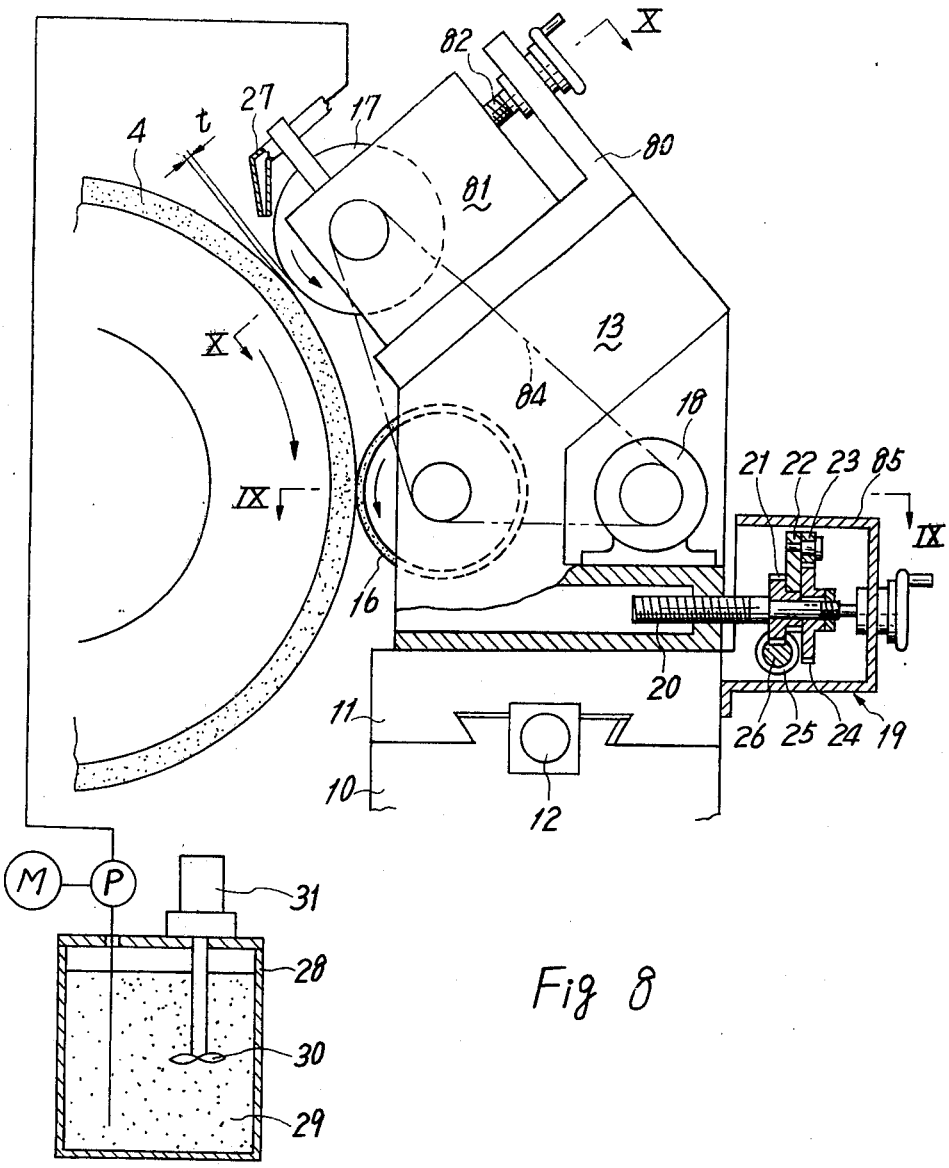
FIG. 8 shows a side elevational view, partly in section, of a third preferred embodiment of the invention.

Fixedly mounted on the roll carriage (first roll carriage) 13, as best shown in FIG. 8, is a guide base 80, on which a second roll carriage 81 is guided slidably toward and away from the grinding wheel 4. The dressing roll 17, the width of which is narrower than that of the grinding wheel 4, is mounted on the secnd roll carriage 81 so as to be rotatable about its axis, which is parallel with the truing roll 18. The roll 17 itself is made of hard metallic material such as, for example, tungsten, tungsten-carbide, steel or the like. An adjusting screw shaft 82, which is rotatably supported on the guide gase 80, is threadedly engaged with the rear end portion of the second roll carriage 81, as seen in FIG. 10, and based upon the rotation of the shaft 82, caused manually, the second carriage 81 can be adjusted to such a slide position as to establish the aforementioned gap ($t$ = approximately $50\mu$) between the dressing roll 17 and the grinding wheel 4.

It is to be noticed that since the diameter of the grinding wheel 4 is large enough, compared with the distance between the truing and dressing rolls 16 and 17, in-feed movement of almost the same amount is effected on both the rolls 16 and 17 when the aforementioned roll carriage (first roll carriage) 13 is forwardly advanced by the in-feed device 19. Still in FIG. 8, a reference numeral 84 designates roll drive belts, through which the truing and dressing rolls 16, 17 are driven by the motor 18 in a counter-clockwise direction to reduce the relative peripheral speed to the grinding wheel 4, as previously mentioned. A reference numeral 85 designates a gear box which is mounted on the traverse slide 11 and on which the in-feed screw shaft 20 is rotatably mounted.

FIG. 12 shows an electrical control circuit used in this particular embodiment. Considering the circuit in light of the circuit shown in FIG. 4, a difference is readily recognized in that a magnetic relay CR4 is employed in lieu of the time relay TR1 and that, in this connection, a normally closed contact *cr*4 of the relay CR4 is connected in a circuit to energize the relay CR3.

Accordingly, when the traverse slide 11 comes back to its original position after a truing operation, the relay CR3 is energized, whereby the coolant fluid and the liberation abrasive grain 29 mixed with the same are supplied to the gap *t* between the dressing roll 17 and the grinding wheel 4. As previously mentioned, the dressing roll 17 has a more narrow width compared with that of the grinding wheel 4, and therefore, the relay CR3 in this particular embodiment, when energized, controls the traverse feed cylinder 12 to be operated again. As a result, the traverse slide 11 is moved by the cylinder 12 also in the dressing operation so as to enable the roll 17 to cover all the peripheral surface of the grinding wheel 4. When the traverse slide 11 returns to its original position after completing a reciprocation movement, a contact *cr*53 is closed and completes a circuit to energize the relay CR4, of which the normally closed contact *cr*4 is in turn opened to thereby deenergize the relay CR3 and, finally, the relay CR4, whereby the whole sequence operation of truing and dressing is completed.

Figure 12A:
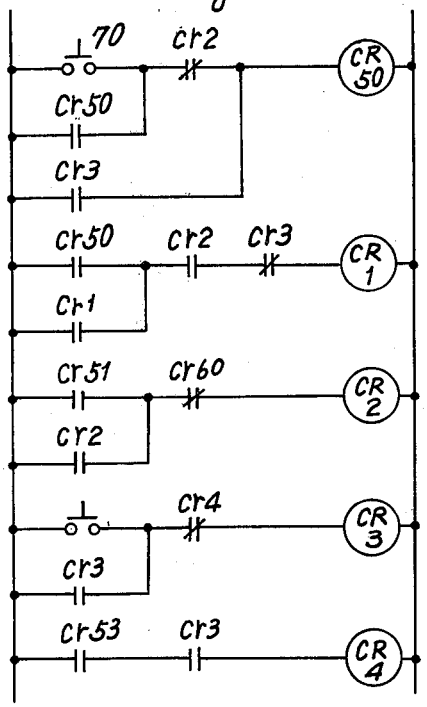
FIG. 12*a* shows a modification of the circuit shown in FIG. 12.

Furthermore, this third embodiment is able to use another control circuit, shown in FIG. 12*a*, in place of the last-described circuit. Like that shown in FIG. 4*a*, this circuit permits the truing operation to be carried out independently of the dressing operation.

The truing operation starts from the depression of a push button switch 70. When the slide 11 returns to its initial position after the truing of the grinding wheel 4, a normally closed contact *cr*60 is opened to de-energize the relay CR2 and, consequently, the truing operation ends with the deenergization of the relay CR50. The dressing operation is carried out when the relay CR3 is energized with the depression of another push button switch 71 and ends with the energization of the relay CR4. The rolls 16, 17 are rotated also during this dressing operation because a normally open contact cr3 of the relay CR3 is connected in parallel with the switch 70 and the normally closed contact *cr*12.

Although in all the above-described embodiments, being made narrower in width than the grinding wheel 4, the truing roll 16 is moved in the axial direction of the same so as to true the grinding wheel 4 through its entire width, if, however, a truing roll is employed, the width of which is wide compared with that of the grinding wheel 4, and which is narrow enough not to affect truing accuracy undesirably, it is possible to perform the truing of the grinding wheel 4 in such a way as to plunge the truing roll toward the grinding wheel 4 at a shifted position where the roll and wheel are properly confronted with each other.

In the present invention, the liberation abrasive grain is not necessarily required to be supplied with itself mixed with coolant fluid, or in other words, the grain 29 is able to either be dropped or gravitationally fed or it may be airblown toward the gap *t* between the grinding wheel 4 and the dressing roll 17. Furthermore, if the dressing roll is such that a synthetic resin which has the same hardness and wear proof characteristics as those of nylon, polyacetal or the like, is covered on the outer periphery of a metallic roll, some of the liberation abrasive grains supplied between the dressing roll and the grinding wheel 4 become embedded into the roll, whereby effective dressing work may be attainable.

It is moreover to be appreciated that the invention may be applicable also to a device in which the tool support 13 is so moved as to trace a template for truing and dressing of a formed grinding wheel. In such a device, it is necessary to make the widths of the truing and dressing rolls identical and narrowed to the extent that the interference between the profile of the formed grinding wheel and the rolls does not occur in the truing and dressing operations, and to move the rolls radially and axially along the template in the course of operation.

Obviously, many modifications and variations of the present invention are possible in light of the above teachings. It is therefore to be understood that within the scope of the appended claims, the invention may be practiced otherwise than as specifically described herein.

We claim:

1. An apparatus for truing and dressing a grinding wheel made of cubic boron nitride and rotatably mounted on a grinding machine, comprising in combination:

roll carriage means slidably mounted on said grinding machine so as to be moved in a first direction heading for said grinding wheel and in a second direction transversely relative to said first direction;

a truing roll provided at an outer peripheral surface thereof with abrasive grain as hard as diamond and rotatably supported on said roll carriage means with its rotational axis parallel with said second direction;

a dressing roll made of metal and rotatably supported on said roll carriage means with its rotational axis parallel with said second direction, said truing and dressing rolls being arranged to establish a gap of a predetermined distance between said dressing roll and said grinding wheel when said roll carriage means is fed to such a position in said first direction as to contact said truing roll with the grinding wheel;

in-feed means for feeding said roll carriage means toward said grinding wheel so as to give an in-feed movement of a predetermined amount to said truing and dressing rolls;

traverse feed means for moving said roll carriage means in said second direction so as to contact said truing roll with said grinding wheel over the entire width of the same in a truing operation and so as to face said dressing roll with said grinding wheel after said truing operation and prior to a dressing operation; and means for supplying liberation abrasive grain toward said gap between said dressing roll and said grinding wheel during said dressing operation, the mean size of said liberation abrasive grain being larger than said gap.

2. An apparatus as claimed in claim 1, wherein said truing and dressing rolls mounted on said roll carriage means are rotatable about a common rotational axis parallel with said second direction, and wherein the radius of said dressing roll is sized to be smaller than that of said truing roll whereby said gap of said predetermined distance is established between said dressing roll and said grinding wheel every time said truing operation is performed.

3. An apparatus as claimed in claim 2, wherein the difference between the radii of said truing and dressing rolls corresponds to said predetermined distance of said gap.

4. An apparatus as claimed in claim 2, further comprising an oscillation mechanism for oscillating said grinding wheel in the axial direction of the same during the dressing operation.

5. An apparatus as claimed in claim 4, wherein said grinding wheel is attached on one end of a wheel spindle rotatably supported on a bearing device, and wherein said oscillation mechanism is incorporated with thrust fluid bearing means of said bearing device so as to oscillate said grinding wheel through the oscillation movement of said wheel spindle.

6. An apparatus as claimed in claim 5, wherein said grain supply means is adapted to supply toward said gap said liberation abrasive grain mixed with a coolant fluid.

7. An apparatus as claimed in claim 6, wherein said grain supply means includes a mixer for mixing said liberation abrasive grain with said coolant fluid.

8. An apparatus for truing and dressing a grinding wheel made of cubic boron nitride and rotatably mounted on a grinding machine, comprising in combination:

wheel truing means provided upon said grinding machine and including a truing roll provided at an outer peripheral surface thereof with abrasive grain as hard as diamond for truing said grinding wheel, said truing roll being rotatable and movable in a first direction heading for said grinding wheel and in a second direction transversely relative to said first direction; and wheel dressing means provided upon said grinding machine and including:

a roll carriage being slidable in said first direction, a dressing roll made of metal and rotatably supported on said roll carriage with its rotational axis parallel with said second direction, feed means for feeding said roll carriage toward and away from said grinding wheel in said first direction so as to grind said dressing roll with said grinding wheel and thereafter to retract said ground dressing roll by a predetermined distance away from said grinding wheel, and means for supplying liberation abrasive grain toward a gap of said predetermined distance established between said grinding wheel and said dressing roll when the same is retracted after being ground with said grinding wheel, the mean size of said liberation abrasive grain being larger than said gap.

9. An apparatus as claimed in claim 8, wherein said feed means comprises:

first feed means for intermittently feeding said roll carriage toward said grinding wheel by a predetermined amount corresponding to a wear amount of said grinding wheel so as to compensate the position of said dressing roll for wear of said grinding wheel, and second feed means for feeding said roll carriage by said predetermined distance from a given position compensated by said first feed means toward said grinding wheel so as to grind said dressing roll with said grinding wheel and for subsequently retracting said roll carriage away from said grinding wheel by said predetermined distance so as to establish said gap of the same predetermined distance between said grinding wheel and said dressing roll.

10. An apparatus as claimed in claim 9, wherein said first feed means comprises a feed screw shaft threadedly engaged with said roll carriage means and screw rotating means for intermittently rotating said feed screw shaft a predetermined angular distance corresponding to said wear amount of said grinding wheel, and wherein said second feed means comprises screw reciprocation means for moving said feed screw shaft in the axial direction of the same within a predetermined stroke corresponding to said gap.

11. An apparatus as claimed in claim 10, wherein said grain supply means is adapted to supply toward said gap said liberation abrasive grain mixed with a coolant fluid.

12. An apparatus as claimed in claim 11, wherein said grain supply means includes a mixer for mixing said liberation abrasive grain with said coolant fluid.

13. An apparatus as claimed in claim 1, wherein said roll carriage means comprises a traverse slide slidably mounted on said grinding machine to be moved in said second direction by said traverse feed means, a first roll carriage slidably mounted on said traverse slide to be moved in said first direction by said in-feed means, and a second roll carriage slidably mounted on said first roll carriage to be adjustable in said first direction, said truing and dressing rolls being rotatably mounted respectively on said first and second roll carriages, with the respective rotational axes parallel with said second direction.

14. An apparatus as claimed in claim 13, further comprising an adjusting means for adjusting the position of said second roll carriage means relative to said grinding wheel so as to establish said gap of said predetermined distance between said grinding wheel and said dressing roll.

15. An apparatus as claimed in claim 14, wherein the respective widths of said truing and dressing rolls are designed to be narrower than that of said grinding wheel, and wherein said traverse feed means is controlled to cause said first and second roll carriages to reciprocatingly slide in said second direction during the truing and dressing operations.

16. An apparatus as claimed in claim 15, wherein said grain supply means is adapted to supply toward said gap said liberasion abrasive grain mixed with a collant fluid.

17. An apparatus as claimed in claim 16, wherein said grain supply means includes a mixer for mixing said liberation abrasive grain with said coolant fluid.

* * * * *